US011335244B2

(12) United States Patent
Wang et al.

(10) Patent No.: US 11,335,244 B2
(45) Date of Patent: May 17, 2022

(54) DISPLAY PANEL INCLUDING SPARE LED ELEMENT AND DISPLAY DEVICE

(71) Applicant: Xiamen Tianma Micro-Electronics Co., Ltd., Xiamen (CN)

(72) Inventors: Ting Wang, Xiamen (CN); Hongbo Zhou, Xiamen (CN); Huangyao Wu, Xiamen (CN)

(73) Assignee: XIAMEN TIANMA MICRO-ELECTRONICS CO., LTD., Xiamen (CN)

( * ) Notice: Subject to any disclaimer, the term of this patent is extended or adjusted under 35 U.S.C. 154(b) by 49 days.

(21) Appl. No.: 16/916,703

(22) Filed: Jun. 30, 2020

(65) Prior Publication Data

US 2021/0343230 A1 Nov. 4, 2021

(30) Foreign Application Priority Data

Apr. 30, 2020 (CN) ..... 202010366556.8

(51) Int. Cl.
*G09G 3/32* (2016.01)

(52) U.S. Cl.
CPC ..... *G09G 3/32* (2013.01); *G09G 2300/0439* (2013.01); *G09G 2300/0809* (2013.01); *G09G 2310/0264* (2013.01); *G09G 2330/08* (2013.01)

(58) Field of Classification Search
None
See application file for complete search history.

(56) References Cited

U.S. PATENT DOCUMENTS

2002/0158585 A1* 10/2002 Sundahl ..... G09G 3/20 315/169.1

FOREIGN PATENT DOCUMENTS

CN 107155373 A 9/2017
CN 109216398 A 1/2019

* cited by examiner

*Primary Examiner* — Chad M Dicke
(74) *Attorney, Agent, or Firm* — von Briesen & Roper, s.c.

(57) ABSTRACT

Disclosed are a display panel and a display device. The display panel includes multiple sub-pixels disposed on a side of a base substrate and multiple first electrode connecting pieces and second electrode connecting pieces. Each sub-pixel includes a pixel driving circuit and an LED element. At least part of adjacent rows of sub-pixels are provided with multiple spare LED element setting regions, the spare LED element setting regions being disposed on at least one side of each row of sub-pixels, and/or at least part of adjacent columns of sub-pixels are provided with the multiple spare LED element setting regions, the spare LED element setting regions being disposed on at least one side of each column of sub-pixels. Two adjacent sub-pixels on two sides of a spare LED element setting region are respectively a first sub-pixel and a second sub-pixel. The first electrode connecting piece electrically connected to the first sub-pixel and the first electrode connecting piece electrically connected to the second sub-pixel both extend to the spare LED element setting region between the first sub-pixel and the second sub-pixel and are insulated from each other. The spare LED element setting region is further provided with a spare second electrode connecting piece.

20 Claims, 12 Drawing Sheets

DISPLAY PANEL INCLUDING SPARE LED ELEMENT AND DISPLAY DEVICE

CROSS-REFERENCE TO RELATED APPLICATIONS

This application claims the priority and benefit of China patent application No. 202010366556.8 filed on Apr. 30, 2020, the disclosure of which is hereby incorporated by reference in its entirety.

TECHNICAL FIELD

Embodiments of the present disclosure relate to the field of display technologies and, in particular, to a display panel and a display device.

BACKGROUND

Currently, Mini-LED and Micro-LED display panels have attracted increasing attention in the display market due to their advantages of high brightness, low working voltage, low power consumption, long service life, impact resistance and stable performance.

Existing Micro-LED display panels include a plurality of sub-pixels arranged in an array, where each sub-pixel includes a light emitting diode (LED) element. Once the LED element is damaged, the corresponding sub-pixel will not be able to display, affecting the display effect. Furthermore, since the LED element has an extremely small size, the replacement of the LED element, if required, would call for a process with extremely high requirements.

SUMMARY

Embodiments of the present disclosure provide a display panel and a display device to solve the problem in the related art that the damage of an LED element affects the display effect.

In a first aspect, an embodiment of the present disclosure provides a display panel including a base substrate, a plurality of sub-pixels, a plurality of first electrode connecting pieces, and a plurality of second electrode connecting pieces.

The plurality of sub-pixels is arranged in an array and disposed on a side of the base substrate, where each of the plurality of sub-pixels includes a pixel driving circuit and an LED element.

A plurality of pixel driving circuits are electrically connected to first electrodes of LED elements of the plurality of sub-pixels in one-to-one correspondence through the plurality of first electrode connecting pieces; and the plurality of second electrode connecting pieces are electrically connected to second electrodes of the LED elements of the plurality of sub-pixels in one-to-one correspondence.

At least part of adjacent rows of sub-pixels are provided with a plurality of spare LED element setting regions between the adjacent rows, and the plurality of spare LED element setting regions are provided on at least one side of each row of the plurality of sub-pixels.

Additionally or alternatively, at least part of adjacent columns of sub-pixels are provided with the plurality of spare LED element setting regions between the adjacent columns, and the plurality of spare LED element setting regions are disposed on at least one side of each column of the plurality of sub-pixels.

Two adjacent sub-pixels on two sides of a spare LED element setting region are respectively a first sub-pixel and a second sub-pixel; both a first electrode connecting piece electrically connected to the first sub-pixel and a first electrode connecting piece electrically connected to the second sub-pixel extend to the spare LED element setting region between the first sub-pixel and the second sub-pixel and are insulated from each other; and the spare LED element setting region is further provided with a spare second electrode connecting piece.

In a second aspect, an embodiment of the present disclosure further provides a display device including the display panel described in the first aspect.

In the display panel and the display device provided by the embodiments of the present disclosure, the spare LED element setting regions are disposed on at least one side of the sub-pixels. Regarding the spare LED element setting regions being disposed on the at least one side of the sub-pixels, the spare LED element setting regions may be disposed between at least part of adjacent two sub-pixels in the row direction, or the spare LED element setting regions may alternatively be disposed between at least part of adjacent two sub-pixels in the column direction, or the spare LED element setting regions may alternatively be disposed between at least part of adjacent two sub-pixels in the row direction and the column direction. Since first electrode connecting pieces of the adjacent two sub-pixels on two sides of the spare LED element setting region both extend to the spare LED element setting region and are insulated from each other, when the LED element is damaged, a spare LED element can be disposed on the spare LED element setting region, such that a pixel driving circuit corresponding to the damaged LED element may be used to drive the spare LED element to emit light through the first electrode connecting piece. Therefore, the problem in the related art is solved that the damage of the LED element causes the sub-pixel where the LED element is located to be unable to display, thus affecting the display effect. In addition, since the first electrode connecting pieces of the adjacent two sub-pixels on two sides of the spare LED element setting region extend to the spare LED element setting region, the pixel driving circuit corresponding to the damaged LED element may be used to drive the spare LED element to emit light through the first electrode connecting piece, so that it is not needed to separately set a pixel driving circuit for the spare LED element, thereby simplifying the process steps.

BRIEF DESCRIPTION OF DRAWINGS

Other features, objects and advantages of the present disclosure will become more apparent from a detailed description of non-restrictive embodiments with reference to the following drawings.

DETAILED DESCRIPTION

Figure 1:
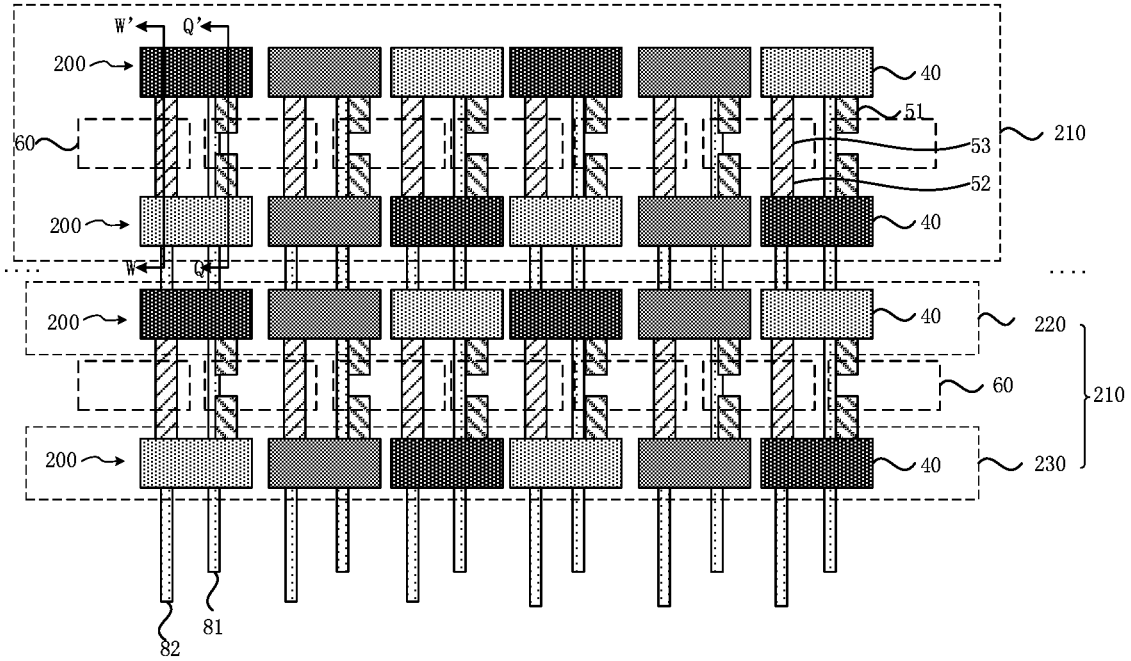
FIG. 1 is a schematic diagram of a display panel according to an embodiment of the present disclosure.

For a better understanding of the objects, technical solutions and advantages of the present disclosure, the technical solutions of the present disclosure will be described below in detail in conjunction with the drawings in embodiments of the present disclosure and the specific embodiments. It should be apparent that the described embodiments are part, not all, of embodiments covered by the present disclosure, and based on the embodiments of the present disclosure, all other embodiments acquired by those skilled in the art without making creative efforts should fall within the scope of the present disclosure.

In view of the problem in the Background section, embodiments of the present disclosure provide a display panel. The display panel includes: a base substrate; a plurality of sub-pixels arranged in an array and disposed on a side of the base substrate, where each of the plurality of sub-pixels includes a pixel driving circuit and an LED element; a plurality of first electrode connecting pieces and a plurality of second electrode connecting pieces, where a plurality of pixel driving circuits are electrically connected to first electrodes of LED elements of the plurality of sub-pixels in one-to-one correspondence through the plurality of the first electrode connecting pieces, and the plurality of second electrode connecting pieces are electrically connected to second electrodes of the LED elements of the plurality of the sub-pixels in one-to-one correspondence; at least part of adjacent rows of sub-pixels are provided with a plurality of spare LED element setting regions between the adjacent rows, and the plurality of spare LED element setting regions are provided on at least one side of each row of the plurality of sub-pixels; and/or at least part of adjacent columns of sub-pixels are provided with the plurality of spare LED element setting regions between the adjacent columns, and the plurality of spare LED element setting regions are provided on at least one side of each column of the plurality of sub-pixels; and two adjacent sub-pixels on two sides of a spare LED element setting region are respectively a first sub-pixel and a second sub-pixel; the first electrode connecting piece electrically connected to the first sub-pixel and the first electrode connecting piece electrically connected to the second sub-pixel both extend to the spare LED element setting region between the first sub-pixel and the second sub-pixel and are insulated from each other; and the spare LED element setting region is further provided with a spare second electrode connecting piece.

By adopting the above-mentioned technical solution, the spare LED element setting regions are disposed on at least one side of the sub-pixels. Regarding the spare LED element setting regions being disposed on the at least one side of the sub-pixels, the spare LED element setting regions may be disposed between at least part of an adjacent two sub-pixels in the row direction, or alternatively the spare LED element setting regions may be disposed between at least part of an adjacent two sub-pixels in the column direction, or alternatively the spare LED element setting regions may be disposed between at least part of an adjacent two sub-pixels in the row direction and the column direction. Since first electrode connecting pieces of the adjacent two sub-pixels on two sides of the spare LED element setting region extend to the spare LED element setting region and are insulated from each other, when the LED element is damaged, a spare LED element may be disposed on the spare LED element setting region, so that a pixel driving circuit corresponding to the damaged LED element may be used to drive the spare LED element to emit light through the first electrode connecting piece. Therefore, the problem in the related art is solved that the damage of the LED element causes the sub-pixel where the LED element is located to be unable to display, thus effecting the display effect. In addition, since the first electrode connecting pieces of the adjacent two sub-pixels on two sides of the spare LED element setting region extend to the spare LED element setting region, the pixel driving circuit corresponding to the damaged LED element can be used to drive the spare LED element to emit light through the first electrode connecting piece, so that it is not needed to separately set a pixel driving circuit for the spare LED element, thereby simplifying the process steps.

Technical solutions in the embodiments of the present disclosure will be described clearly and completely in conjunction with the drawings in the embodiments of the present disclosure. Based on the embodiments of the present disclosure, all other embodiments obtained by those skilled in the art without making creative efforts shall fall in the scope of the embodiments of the present disclosure.

Figure 2:
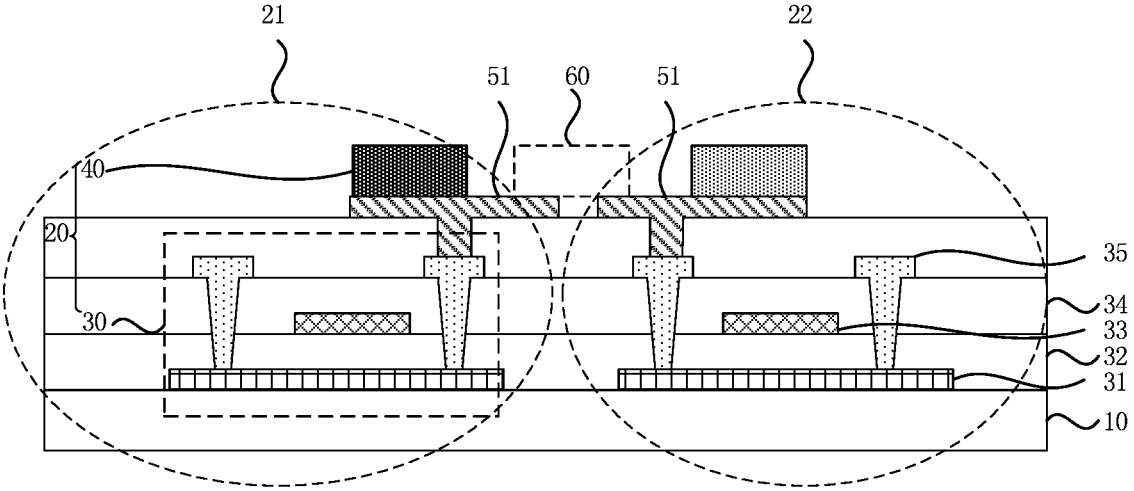
FIG. 2 is a cross-sectional view taken along line Q-Q' shown in FIG. 1.
Figure 3:
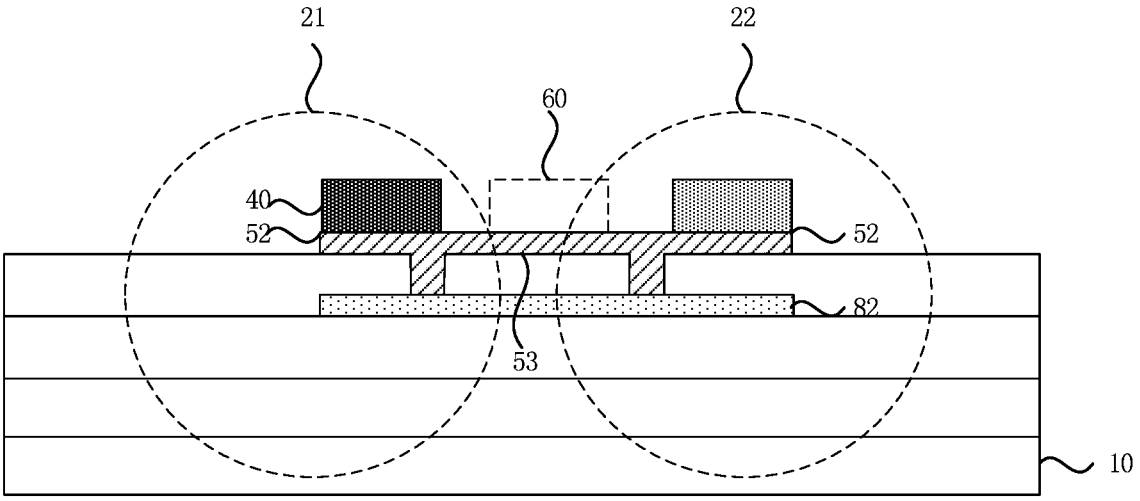
FIG. 3 is a cross-sectional view taken along line W-W' shown in FIG. 1.

FIG. 1 is a schematic diagram of a display panel according to an embodiment of the present disclosure. FIG. 2 is a cross-sectional view taken alone line Q-Q shown in FIG. 1. FIG. 3 is a cross-sectional view taken along line W-W shown in FIG. 1. As shown in FIG. 1, FIG. 2 and FIG. 3, the display panel includes: a base substrate 10; a plurality of sub-pixels 20 arranged in an array and disposed on a side of the base substrate 10, where each of the plurality of sub-pixels 20 includes a pixel driving circuit 30 and an LED element 40; a plurality of first electrode connecting pieces 51 and a plurality of second electrode connecting pieces 52, where a plurality of pixel driving circuits 30 are electrically connected to first electrodes of LED elements 40 of the plurality of sub-pixels 20 in one-to-one correspondence through the plurality of the first electrode connecting pieces 51, and the plurality of second electrode connecting pieces 52 are electrically connected to second electrodes of the LED elements 40 of the plurality of the sub-pixels 20 in one-to-one correspondence; at least part of adjacent rows of sub-pixels are provided with a plurality of spare LED element setting regions 60 between the adjacent rows, and the plurality of spare LED element setting regions 60 are provided on at least one side of each row of the plurality of sub-pixels; two adjacent sub-pixels 20 on two sides of a spare LED element setting region 60 are respectively a first sub-pixel 21 and a second sub-pixel 22; the first electrode connecting piece 51 electrically connected to the first sub-pixel 21 and the first electrode connecting piece 51 electrically connected to the second sub-pixel 22 both extend to the spare LED element setting region 60 between the first sub-pixel 21 and the second sub-pixel 22 and are insulated from each other; and the spare LED element setting region 60 is further provided with a spare second electrode connecting piece 53.

The display panel may include a plurality of scanning lines and a plurality of data lines, the plurality of scanning lines and the plurality of data lines cross over each other and define a plurality of sub-pixel regions, and each sub-pixel region is provided with a sub-pixel 20. By scanning a sub-pixel row line by line, a data signal can be written line by line, and then all the sub-pixels 20 can be lit line by line to complete a display of a frame to be displayed.

The pixel driving circuit 30 drives a corresponding LED element 40 to emit light. Referring to FIG. 2, the pixel driving circuit 30 may include an active layer 31, a first insulating layer 32, a first metal layer 33, a second insulating layer 34 and a second metal layer 35 disposed on a side of the base substrate 10 in sequence. A gate, a scanning line and a first plate of a storage capacitor in the pixel driving circuit 30 may be formed in the first metal layer 33. A source, a drain, a data line and a power source signal line in the pixel driving circuit 30 may be formed in the second metal layer 35. The first insulating layer 32 and the second insulating layer 34 may be made of materials including an oxide of silicon or a nitride of silicon, which will not be limited in the embodiments of the present disclosure. The pixel driving circuit 30 may further include a third insulating layer and a third metal layer (not shown in the figure) stacked in a direction facing away from the base substrate 10 and disposed between the first metal layer 33 and the second insulating layer 34. A second plate of the storage capacitor and a reference voltage line may generally be formed in the third metal layer.

It is to be noted that the sub-pixel 20 includes the pixel driving circuit 30 and the LED element 40, and the LED element 40 is a part of the sub-pixel 20 and has a small size. In some optional embodiments, the LED element 40 may be a Micro-LED or other LED element with a small size that may correspond to the sub-pixel, which is not specifically limited in this embodiment.

Specifically, at least part of the adjacent rows of sub-pixels 20 are provided with the plurality of spare LED element setting regions 60, and at least one side of each row of the plurality of sub-pixels 20 is provided with the plurality of spare LED element setting regions 60. That is, in the column direction, each sub-pixel 20 includes at least one spare LED element setting region 60. When the LED element 40 is damaged, a spare LED element is disposed in the spare LED element setting region 60. Since a pixel driving circuit 30 corresponding to the damaged LED element 40 is electrically connected to the first electrode through the first electrode connecting piece 51, and the first electrode connecting piece 51 of the damaged LED element 40 extends to the spare LED element setting region 60, the pixel driving circuit 30 corresponding to the damaged LED element 40 may be used to drive the spare LED element to emit light through the first electrode connecting piece 51. That is, the spare LED element replaces the damaged LED element 40 to emit light, thereby achieving display of the sub-pixel 20 and solving the problem in the related art that the damage of the LED element 40 causes the sub-pixel 20 where the LED element 40 is located to be unable to display, thus affecting the display effect. In addition, the pixel driving circuit 30 corresponding to the damaged LED element 40 may be used to drive the spare LED element to emit light through the first electrode connecting piece 51, such that it is not needed to separately set a pixel driving circuit 30 for the spare LED element, thereby simplifying the process steps.

Exemplarily, still referring to FIG. 1, the plurality of sub-pixels 20 arranged in the array includes a plurality of sub-pixel rows 200, the plurality of sub-pixel rows 200 includes a plurality of sub-pixel row units 210, the sub-pixel row unit 210 includes a first sub-pixel row 220 and a second sub-pixel row 230, and the plurality of spare LED element setting regions 60 is disposed between the first sub-pixel row 220 and the second sub-pixel row 230. Specifically, in the column direction, adjacent two sub-pixels 20 of a same column in one sub-pixel row unit 210 is provided with one spare LED element setting region 60, that is, two sub-pixels 20 share one spare LED element setting region 60, and first electrode connecting pieces 51 electrically connected to the two sub-pixels 20 extend in the column direction to the spare LED element setting region 60 and are insulated from each other. When an LED element in one of the two sub-pixels 20 is damaged, a spare LED element having a same structure and luminous color as the damaged LED element is disposed in the spare LED element setting region 60. Since the first electrode connecting piece 51 of the damaged LED element extends to the spare LED element setting region 60, the pixel driving circuit corresponding to the damaged LED element is used to drive the spare LED element to emit light through the first electrode connecting piece 51. That is, the spare LED element is disposed in the spare LED element setting region 60 to replace the damaged LED for emitting light. Alternatively, when an LED element in the other sub-pixel 20 is damaged, the spare LED element having the same structure and luminous color as the damaged LED element is disposed in the spare LED element setting region 60. Since the first electrode connecting piece 51 of the damaged LED element similarly extends to the spare LED element setting region 60, the pixel driving circuit corresponding to the damaged LED element is used to drive the spare LED element to emit light through the first electrode connecting piece 51. That is, the spare LED element is disposed in the spare LED element setting region 60 to replace the damaged LED for light emission. In this way, display of the sub-pixel is achieved, and the problem in the related art is solved that the damage of the LED element causes the sub-pixel where the LED element is located to be unable to display, thus affecting the display effect. In addition, since the adjacent two sub-pixels 20 of the same column in one sub-pixel row unit 210 share one spare LED element setting region 60, compared with one sub-pixel 20 being provided with one spare LED element setting region 60, this embodiment reduces a number of the spare LED element setting regions 60 by having two sub-pixels 20 share one spare LED element setting region 60. In this way, an area occupied by the spare LED element setting regions 60 is reduced, and a larger number of sub-pixels 20 may be provided, thereby improving the resolution of the display panel.

Figure 4:
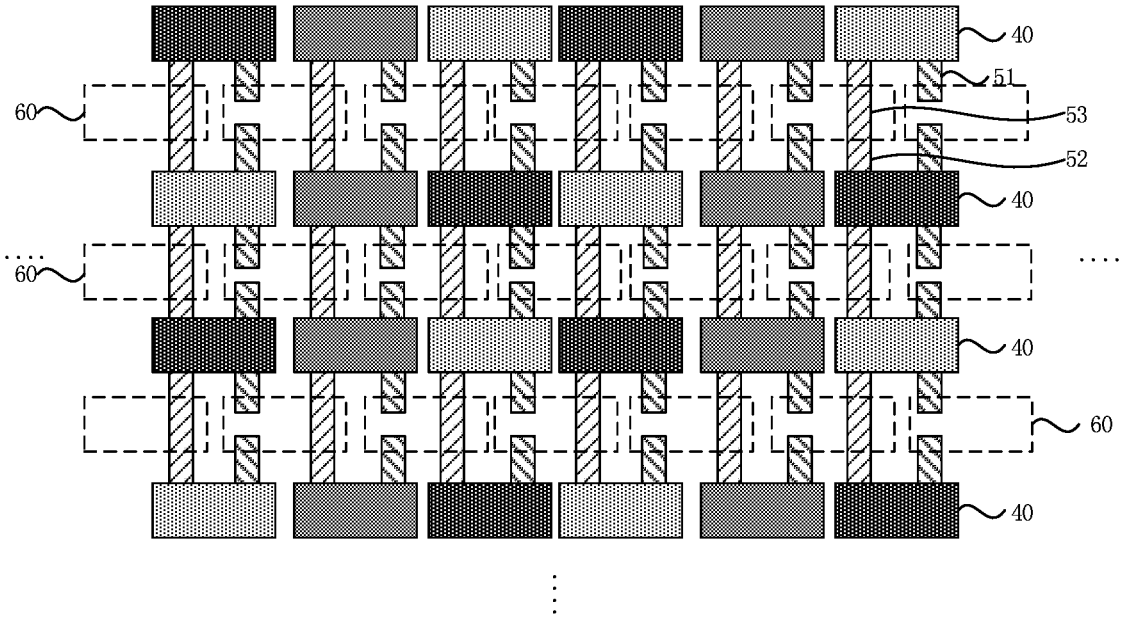
FIG. 4 is a schematic diagram of another display panel according to an embodiment of the present disclosure.

Exemplarily, FIG. 4 is a schematic diagram of another display panel according to an embodiment of the present disclosure. As shown in FIG. 4, in the column direction, the adjacent two sub-pixels 20 of the same column is provided with one spare LED element setting region 60, that is, in the column direction, two sides of one sub-pixel 20 are provided with the spare LED element setting regions 60 respectively. That is to say, one sub-pixel 20 includes two spare LED element setting regions 60. Specifically, in the column direction, a first electrode connecting piece 51 corresponding to one sub-pixel 20 extends to two spare LED element setting regions 60 in the column direction separately. When an LED element 40 in one sub-pixel 20 is damaged, the spare LED element for the damaged LED element 40 may be disposed in one of the two spare LED element setting regions 60. Since the first electrode connecting piece 51 corresponding to the damaged LED element 40 extends to the spare LED element setting region 60, the pixel driving circuit 30 corresponding to the damaged LED element 40 may be used to drive the spare LED element to emit light through the first electrode connecting piece 51, that is, the spare LED element replaces the damaged LED element 40 to emit light to achieve the display of the sub-pixel 20. In this way, the problem in the related art is solved that the damage of the LED element 40 causes the sub-pixel 20 where the LED element 40 is located to be unable to display, thus affecting the display effect. In addition, compared with one sub-pixel 20 being provided with one spare LED element setting region 60, this embodiment increases a number of the spare LED element setting regions 60 provided for each sub-pixel 20 by having one sub-pixel 20 include two spare LED element setting regions 60, such that if one of the two spare LED element setting regions 60 cannot work, the spare LED element may be disposed in the other spare LED element setting region 60, thereby achieving an effect that the spare LED element replaces the damaged LED element to emit light.

Figure 5:
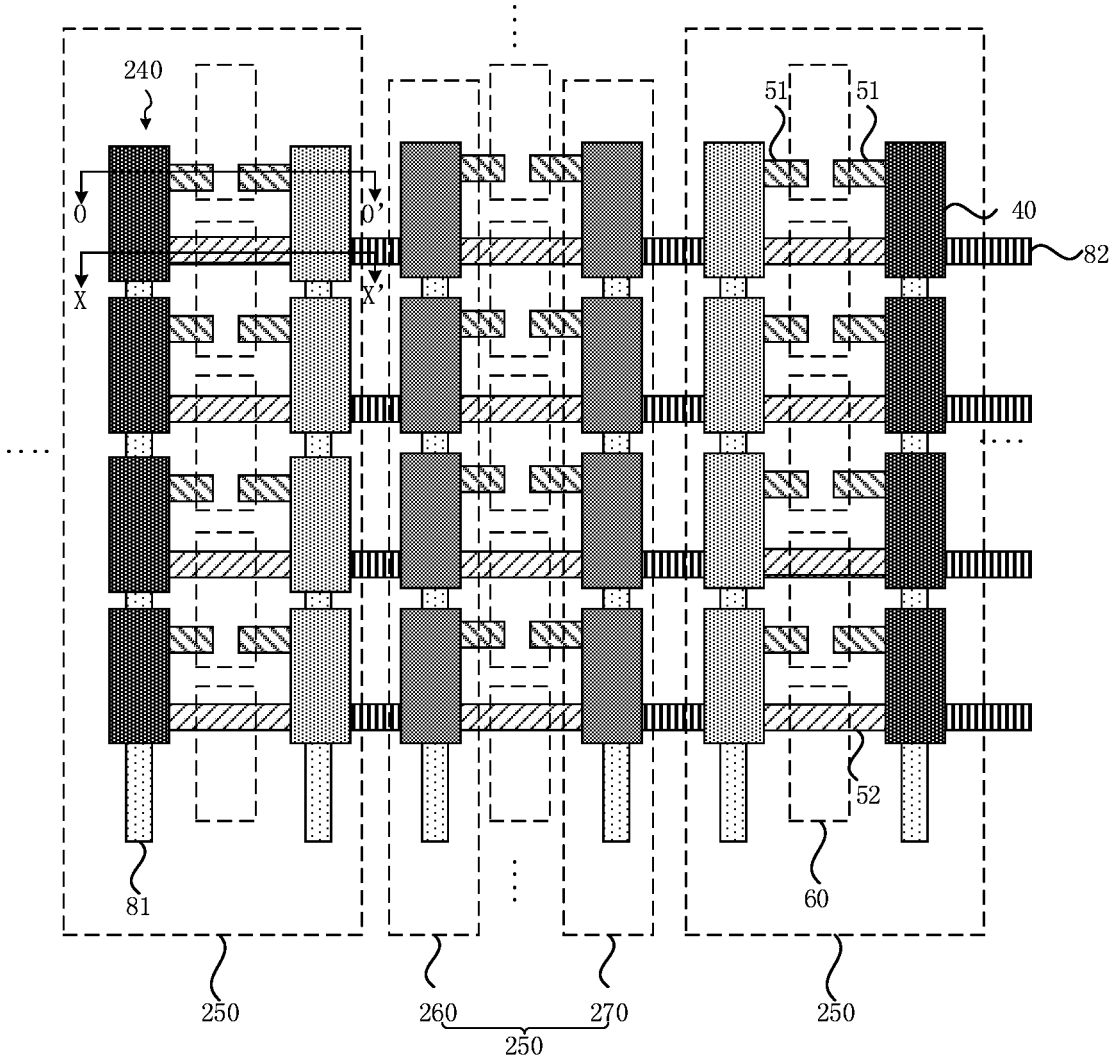
FIG. 5 is a schematic diagram of another display panel according to an embodiment of the present disclosure.
Figure 6:
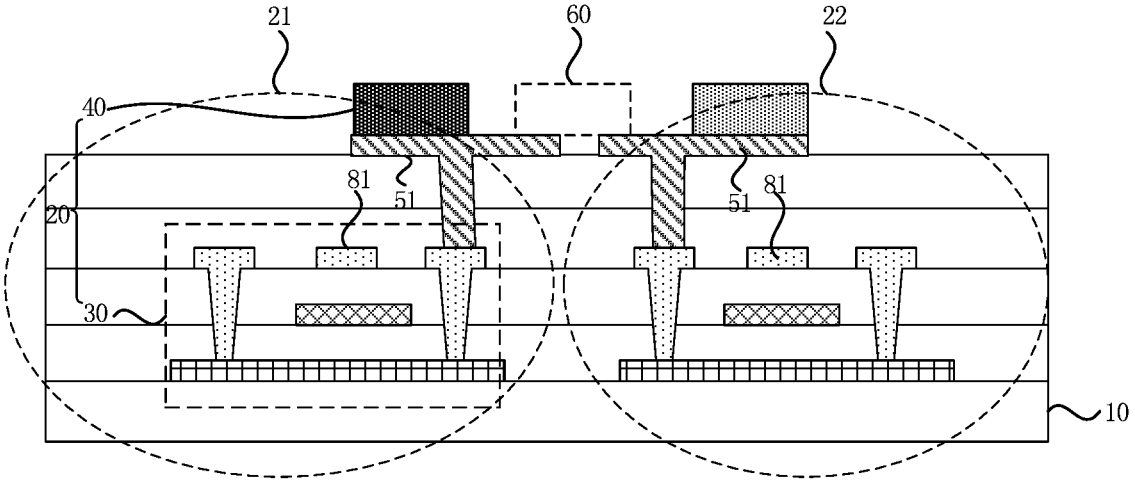
FIG. 6 is a cross-sectional view taken along line O-O' shown in FIG. 5.
Figure 7:
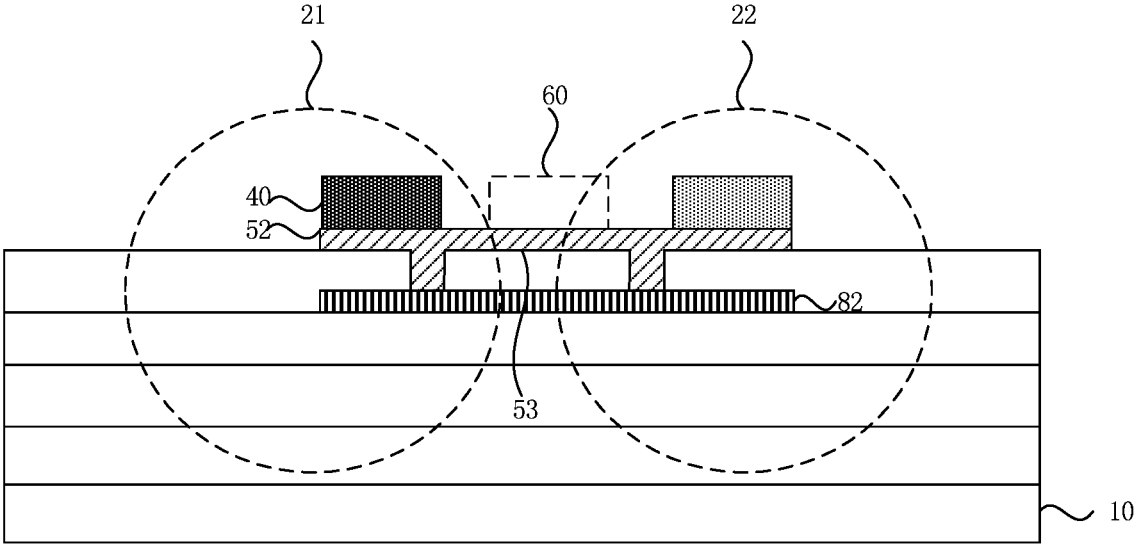
FIG. 7 is a cross-sectional view taken along line X-X' shown in FIG. 5.

FIG. 5 is a schematic diagram of a display panel according to an embodiment of the present disclosure. FIG. 6 is a cross-sectional view taken along line O-O' shown in FIG. 5. FIG. 7 is a cross-sectional view taken alone line X-X' shown in FIG. 5. As shown in FIG. 5, FIG. 6 and FIG. 7, the display panel includes: the base substrate 10; the plurality of sub-pixels 20 arranged in the array and disposed on the side of the base substrate 10, where each of the plurality of sub-pixels 20 includes the pixel driving circuit 30 and the LED element 40; the plurality of first electrode connecting pieces 51 and the plurality of second electrode connecting pieces 52, where the plurality of pixel driving circuits 30 is electrically connected to the first electrodes of the LED elements 40 of the plurality of sub-pixels 20 in one-to-one correspondence through the plurality of first electrode connecting pieces 51, and the plurality of second electrode connecting pieces 52 is electrically connected to the second electrodes of the LED elements 40 of the plurality of sub-pixels 20 in one-to-one correspondence; at least part of adjacent columns of sub-pixels are provided with the plurality of spare LED element setting regions 60, and at least one side of each column of the plurality of sub-pixels is provided with the plurality of spare LED element setting regions 60; two adjacent sub-pixels 20 on two sides of the spare LED element setting region 60 are respectively the first sub-pixel 21 and the second sub-pixel 22; both the first electrode connecting piece 51 electrically connected to the first sub-pixel 21 and the first electrode connecting piece 51 electrically connected to the second sub-pixel 22 extend to the spare LED element setting region 60 between the first sub-pixel 21 and the second sub-pixel 22 and are insulated from each other; and the spare LED element setting region 60 is further provided with the spare second electrode connecting piece 53.

Specifically, at least part of the adjacent columns of sub-pixels 20 are provided with the plurality of spare LED element setting regions 60, and at least one side of each column of the plurality of sub-pixels 20 is provided with the plurality of spare LED element setting regions 60. That is, in the row direction, each sub-pixel 20 includes at least one spare LED element setting region 60. When the LED element 40 is damaged, the spare LED element is disposed in the spare LED element setting region 60, since the pixel driving circuit 30 corresponding to the damaged LED element 40 is electrically connected to the first electrode through the first electrode connecting piece 51, and the first electrode connecting piece 51 of the damaged LED element 40 extends to the spare LED element setting region 60, the pixel driving circuit 30 corresponding to the damaged LED element 40 may be used to drive the spare LED element to emit light through the first electrode connecting piece 51. That is, the spare LED element replaces the damaged LED element to emit light, thereby achieving display of the sub-pixel 20 and solving the problem in the related art that the damage of the LED element 40 causes the sub-pixel 20 where the LED element 40 is located to be unable to display, thus affecting the display effect. In addition, the pixel driving circuit 30 corresponding to the damaged LED element 40 is used to drive the spare LED element to emit light through the first electrode connecting piece 51, such that it is not needed to separately set the pixel driving circuit 30 for the spare LED element, thereby simplifying the process steps.

Exemplarily, still referring to FIG. 5, the plurality of sub-pixels 20 arranged in the array includes a plurality of sub-pixel columns 240, the plurality of sub-pixel columns 240 includes a plurality of sub-pixel column units 250, the sub-pixel column unit 250 includes a first sub-pixel column 260 and a second sub-pixel column 270, and the plurality of spare LED element setting regions 60 is disposed between the first sub-pixel column 260 and the second sub-pixel column 270. Specifically, in the row direction, adjacent two sub-pixels 20 of a same row in one sub-pixel column unit 250 are provided with one spare LED element setting region 60, that is, two sub-pixels 20 share one spare LED element setting region 60, and first electrode connecting pieces 51 electrically connected to the two sub-pixels 20 extend in the row direction to the spare LED element setting region 60 and are insulated from each other. When an LED element 40 in one sub-pixel 20 is damaged, a spare LED element having a same structure and luminous color as the damaged LED element is disposed in the spare LED element setting region 60. Since the first electrode connecting piece 51 of the damaged LED element extends to the spare LED element setting region 60, the pixel driving circuit 30 corresponding to the damaged LED element is used to drive the spare LED element to emit light through the first electrode connecting piece 51, that is, the spare LED element replaces the damaged LED 40 to emit light. Alternatively, when an LED element in the other sub-pixel 20 is damaged, the spare LED element having the same structure and luminous color as the damaged LED element is disposed in the spare LED element setting region 60. Since the first electrode connecting piece 51 of the damaged LED element 40 similarly extends to the spare LED element setting region 60, the pixel driving circuit corresponding to the damaged LED element 40 is used to drive the spare LED element to emit light through the first electrode connecting piece 51, that is, the spare LED element replaces the damaged LED 40 to emit light. In this way, the display of the sub-pixel is achieved, and the problem in the related art is solved that the damage of the LED element causes the sub-pixel 20 where the LED element is located to be unable to display thus affecting the display effect. In addition, since the adjacent two sub-pixels 20 of the same row in one sub-pixel row unit 210 share one spare LED element setting region 60, compared with one sub-pixel 20 being provided with one spare LED element setting region 60, this embodiment reduces a number of the spare LED element setting regions 60 by having two sub-pixels 20 share one spare LED element setting region 60. In this way, an area occupied by the spare LED element setting regions 60 is reduced, and a larger number of sub-pixels 20 may be provided, thereby improving the resolution of the display panel.

Figure 8:
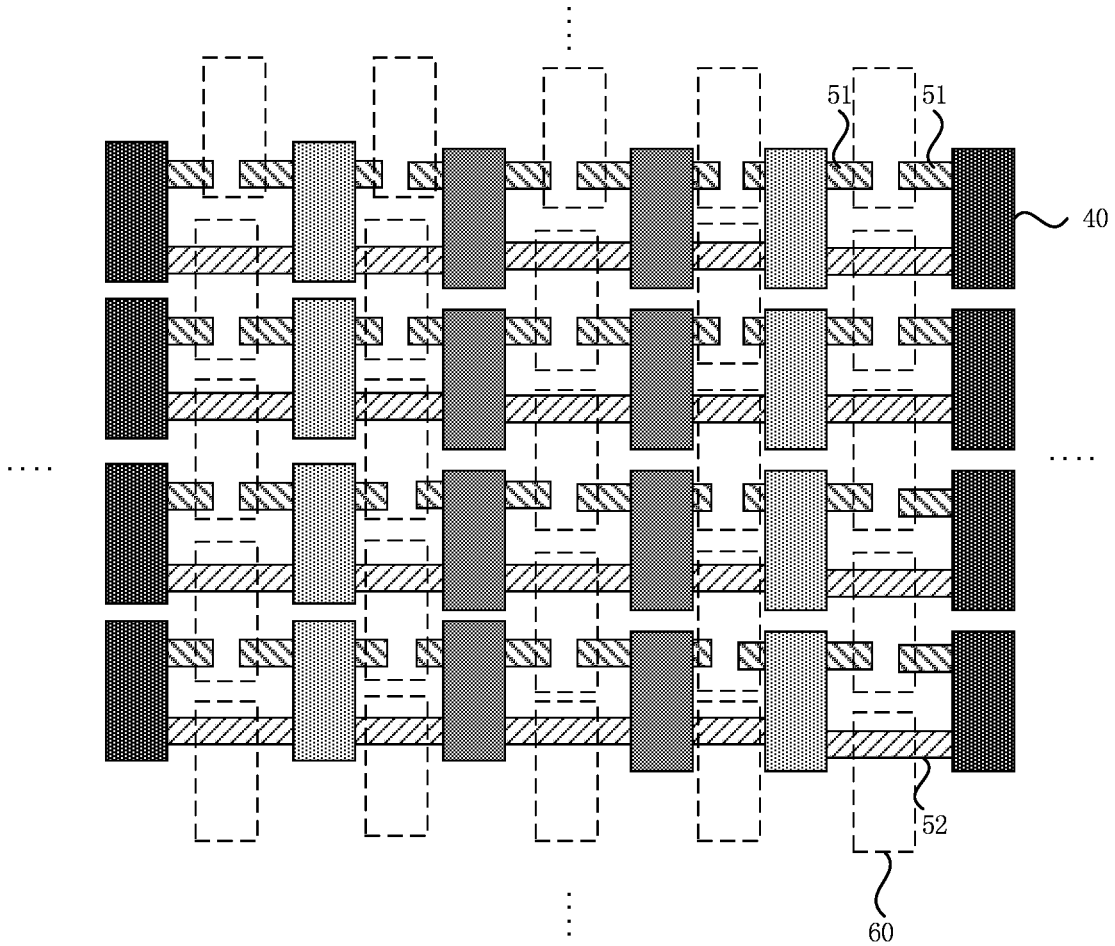
FIG. 8 is a schematic diagram of another display panel according to an embodiment of the present disclosure.

Exemplarily, FIG. 8 is a schematic diagram of another display panel according to an embodiment of the present disclosure. As shown in FIG. 8, in the row direction, the adjacent two sub-pixels 20 of the same row are provided with one spare LED element setting region 60, that is, in the row direction, two sides of one sub-pixel 20 are provided with the spare LED element setting regions 60 respectively. That is to say, one sub-pixel 20 includes two spare LED element setting regions 60. Specifically, in the row direction, a first electrode connecting piece 51 corresponding to one sub-pixel 20 extends to two spare LED element setting regions 60 in the row direction separately. When an LED element 40 in one sub-pixel 20 is damaged, the spare LED element for the damaged LED element 40 may be disposed in one of the two spare LED element setting regions 60. Since the first electrode connecting piece 51 corresponding to the damaged LED element 40 extends to the spare LED element setting region 60, the pixel driving circuit 30 corresponding to the damaged LED element 40 may be used to drive the spare LED element to emit light through the first electrode connecting piece 51, that is, the spare LED element replaces the damaged LED element 40 to emit light to achieve the display of the sub-pixel 20. In this way, the problem in the related art is solved that the sub-pixel 20 where the LED element 40 is located cannot be displayed due to the damage of the LED element 40, thus affecting the display effect In addition, compared with one sub-pixel 20 being provided with one spare LED element setting region 60, this embodiment increases a number of the spare LED element setting regions 60 by having one sub-pixel 20 include two spare LED element setting regions 60, so that when one of the two spare LED element setting regions 60 cannot work, the spare LED element may be disposed in the other spare LED element setting region 60, thereby achieving the effect that the spare LED element replaces the damaged LED element for light emission.

Figure 9:
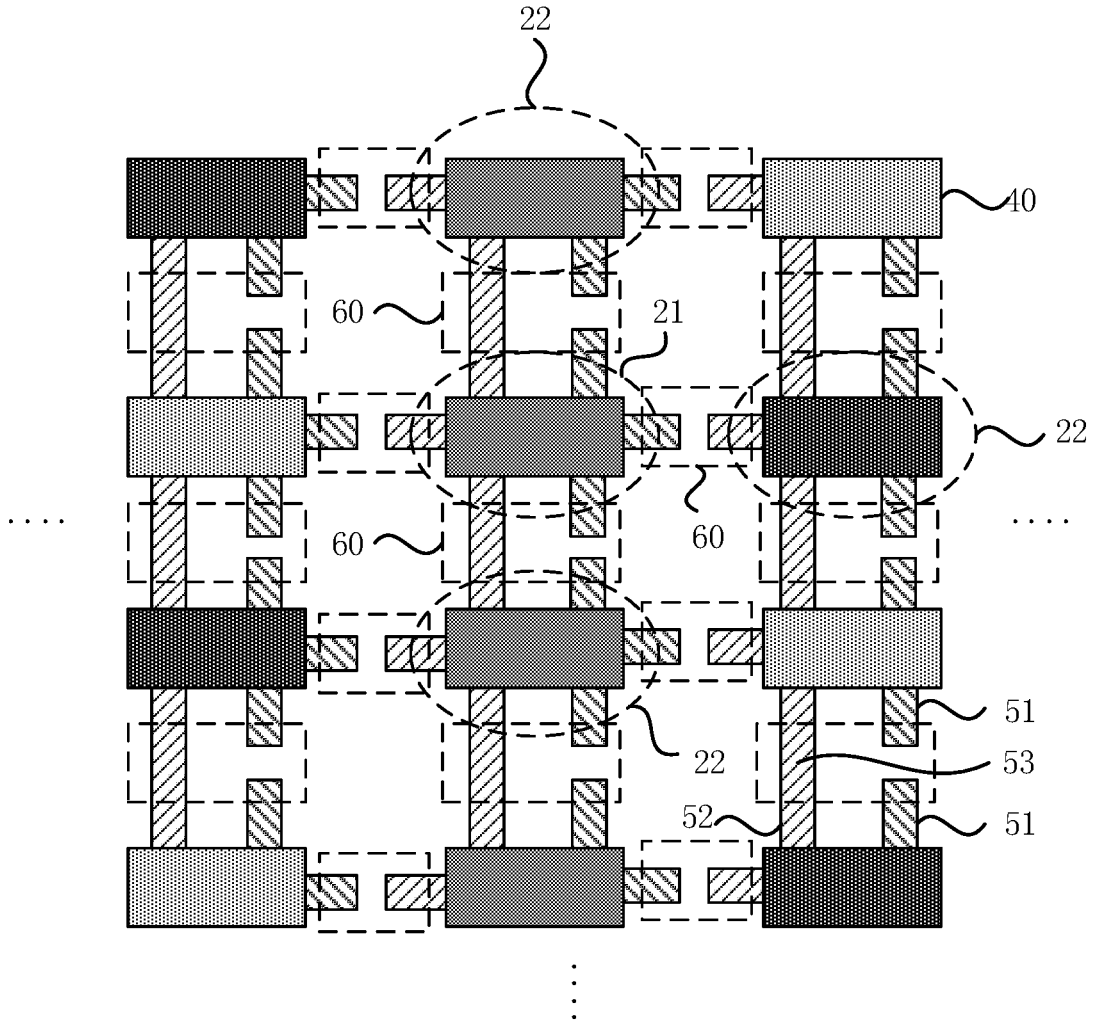
FIG. 9 is a schematic diagram of another display panel according to an embodiment of the present disclosure.

FIG. 9 is a schematic diagram of another display panel according to an embodiment of the present disclosure. As shown in FIG. 9, the display panel includes: the base substrate 10; the plurality of sub-pixels 20 arranged in the array and disposed on the side of the base substrate 10, where each of the plurality of sub-pixels 20 includes the pixel driving circuit 30 and the LED element 40; the plurality of first electrode connecting pieces 51 and the plurality of second electrode connecting pieces 52, where the plurality of pixel driving circuits 30 is electrically connected to first electrodes of LED elements 40 of the plurality of sub-pixels 20 in one-to-one correspondence through the plurality of first electrode connecting pieces 51, and the plurality of second electrode connecting pieces 52 is electrically connected to second electrodes of the LED elements 40 of the plurality of sub-pixels 20 in one-to-one correspondence; at least part of adjacent rows of sub-pixels are provided with a plurality of spare LED element setting regions 60, and at least one side of each row of the plurality of sub-pixels is provided with the plurality of spare LED element setting regions 60; and/or, at least part of adjacent columns of sub-pixels are provided with the plurality of spare LED element setting regions 60, and at least one side of each column of the plurality of sub-pixels is provided with the plurality of spare LED element setting regions 60; and two adjacent sub-pixels 20 on two sides of the spare LED element setting region 60 are respectively the first sub-pixel 21 and the second sub-pixel 22; both the first electrode connecting piece 51 electrically connected to the first sub-pixel 21 and the first electrode connecting piece 51 electrically connected to the second sub-pixel 22 extend to the spare LED element setting region 60 between the first sub-pixel 21 and the second sub-pixel 22 and are insulated from each other; and the spare LED element setting region 60 is further provided with the spare second electrode connecting piece 53.

Specifically, in the row direction, at least part of the adjacent two sub-pixels 20 in the same row are provided with one spare LED element setting region 60, and in the row direction, at least one side of one sub-pixel 20 is provided with the spare LED element setting region 60 separately, that is to say, in the row direction, one sub-pixel 20 includes at least one spare LED element setting region 60. In the column direction, at least part of the adjacent two sub-pixels 20 in the same column are provided with one spare LED element setting region 60, and in the column direction, at least one side of one sub-pixel 20 is provided with the spare LED element setting region 60 separately, that is to say, in the column direction, one sub-pixel 20 includes at least one spare LED element setting region 60. In this way, when an LED element 40 in one sub-pixel 20 is damaged, the spare LED element having the same structure and luminous color as the damaged LED element 40 may be disposed in one of the at least two spare LED element setting regions 60. Since the first electrode connecting piece 51 corresponding to the damaged LED element 40 extends to the spare LED element setting region 60, the pixel driving circuit 30 corresponding to the damaged LED element 40 may be used to drive the spare LED element to emit light through the first electrode connecting piece 51, that is, the spare LED element replaces the damaged LED element 40 to emit light to achieve the display of the sub-pixel 20. In this way, the problem in the related art is solved that the sub-pixel 20 where the LED element 40 is located cannot be displayed due to the damage of the LED element 40, thus affecting the display effect. In addition, compared with one sub-pixel 20 being provided with one spare LED element setting region 60, this embodiment increases a number of the spare LED element setting regions 60 by having one sub-pixel 20 include at least two spare LED element setting regions 60, such that if one of the at least two spare LED element setting regions 60 cannot work, the spare LED element may be disposed in the other spare LED element setting regions 60.

Exemplarily, referring to FIG. 9, in the row direction, one side of the first sub-pixel 21 is provided with one spare LED element setting region 60, specifically, in the row direction, the first electrode connecting piece 51 electrically connected to the first sub-pixel 21 extends to the spare LED element setting region 60 between the first sub-pixel 21 and the second sub-pixel 22. Simultaneously, in the column direction, two sides of the first sub-pixel 21 are provided with the spare LED element setting regions 60, specifically, in the column direction, the spare LED element setting regions 60 are disposed between two second sub-pixels 22 adjacent to the first sub-pixel 21, and specifically, in the column direction, both the first electrode connecting piece 51 electrically connected to the first sub-pixel 21 and the first electrode connecting piece 51 electrically connected to the two second sub-pixels 22 adjacent to the first sub-pixel 21 extend to the spare LED element setting regions 60 between the first sub-pixel 21 and the second sub-pixels 22 and are insulated from each other. This achieves the effect that one sub-pixel 20 includes three spare LED element setting regions 60.

It is to be noted that, FIG. 9 merely illustrates that in the row direction one sub-pixel 20 includes one spare LED element setting region 60, and in the column direction the one sub-pixel 20 includes two spare LED element setting regions 60. That is, each sub-pixel includes three spare LED element setting regions 60, which does not constitute a limitation of the present application, and those skilled in the art can make configurations according to the actual situation so long as when the LED element 40 is damaged, the spare LED element may be disposed in the spare region 60, so that the display of the sub-pixel 20 can be achieved by replacing the damaged LED element 40 with the spare LED element for emitting light.

Optionally, still referring to FIG. 1, FIG. 3, FIG. 4, FIG. 5, FIG. 7, FIG. 8 and FIG. 9, the spare second electrode connecting piece 53 and the second electrode connecting piece 52 are connected in an integral structure. Advantages of this configuration are described below. The spare second electrode connecting piece 53 and the second electrode connecting piece 52 need not be patterned separately, simplifying the process steps. In addition, since the spare second electrode connecting piece 53 and the second electrode connecting piece 52 receive a same signal, that is, both are cathode signals, when the spare second electrode connecting piece 53 and the second electrode connecting piece 52 are connected in the integral structure, interference between signals is not caused.

Figure 10:
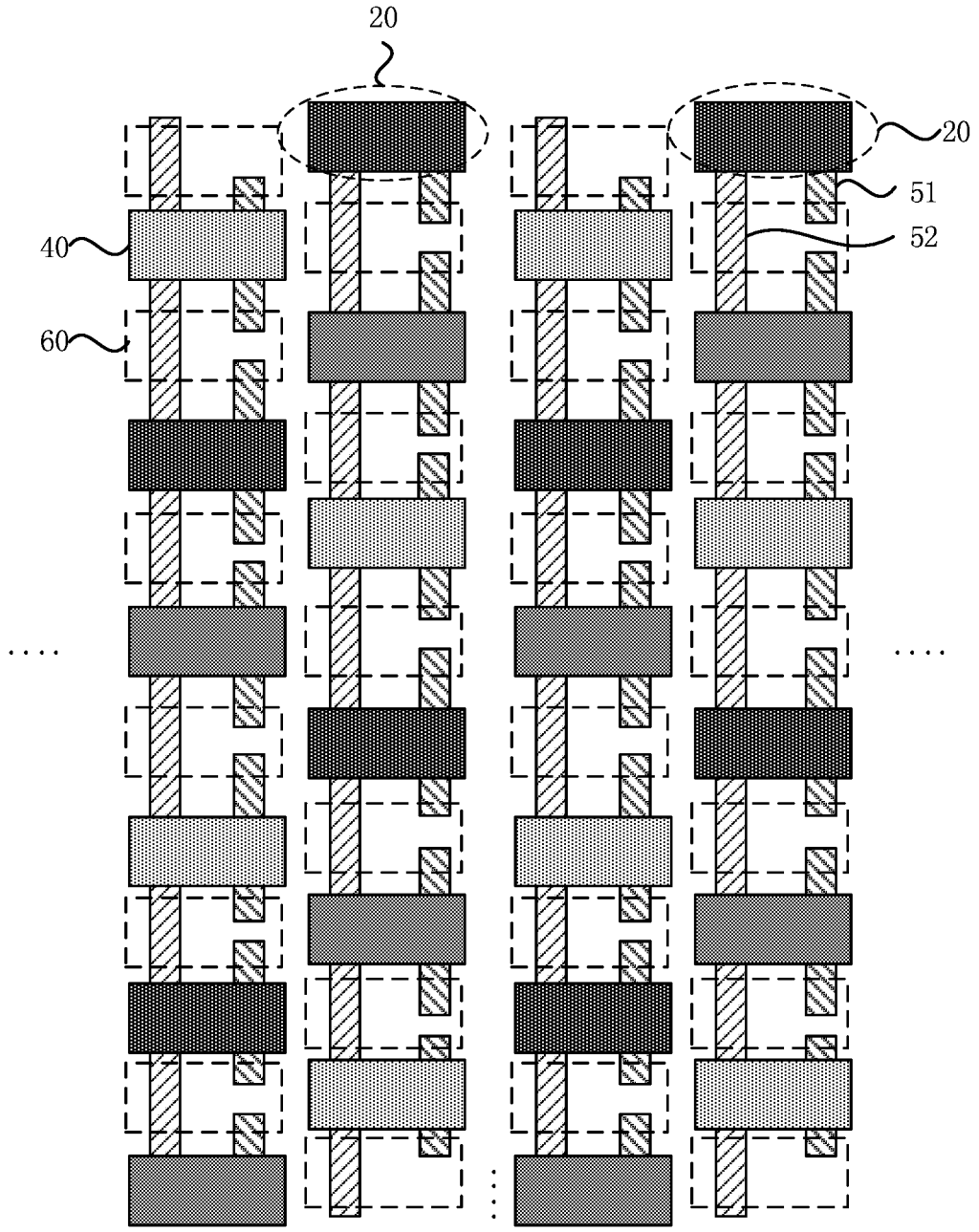
FIG. 10 is a schematic diagram of another display panel according to an embodiment of the present disclosure.

Optionally, FIG. 10 is a schematic diagram of another display panel according to an embodiment of the present disclosure. As shown in FIG. 10, in the same column, two sub-pixels 20 in adjacent rows are provided with one spare LED element setting region 60. That is, in the column direction, one sub-pixel 20 includes two spare LED element setting regions 60, spare LED element setting regions 60 in adjacent two columns are misaligned, and the sub-pixels 20 are misaligned. A display color of sub-pixels in a first sub-pixel row is a first color, a display color of sub-pixels in a second sub-pixel row is a second color, a display color of sub-pixels in a third sub-pixel row is a third color, a display color of sub-pixels in a fourth sub-pixel row is the first color, a display color of sub-pixels in a fifth sub-pixel row is the second color, and a display color of sub-pixels in a sixth sub-pixel row is the third color, and so on. The first color may be red, the second color may be blue, and the third color may be green. Advantages of this arrangement are described below. When the LED element 40 is damaged, the spare LED element can replace the damaged LED element to emit light. Display of the display panel is more uniform and the display effect of the display panel is improved due to a dislocation arrangement between the sub-pixels 20. It is to be noted that the arrangement of the sub-pixels 20 and the spare LED element setting regions 60 will not be limited to the dislocation arrangement, and those skilled in the art may configure the arrangement of the sub-pixels 20 and the spare LED element setting regions 60 depending on specific contexts, which will not be specifically limited in this embodiment. Furthermore, the color displayed by the sub-pixels 20 is not limited to the above-mentioned examples, and those skilled in the art may select depending on actual contexts.

In summary, in the display panel provided by the embodiments of the present disclosure, the spare LED element setting regions are disposed on at least one side of the sub-pixels. For the spare LED element setting regions being disposed on the at least one side of the sub-pixels, the spare LED element setting regions may be disposed between at least part of adjacent two sub-pixels in the row direction, the spare LED element setting regions may further be disposed between at least part of adjacent two sub-pixels in the column direction, or the spare LED element setting regions may further be disposed between at least part of adjacent two sub-pixels in the row direction and the column direction. Since first electrode connecting pieces of the adjacent two sub-pixels on two sides of the spare LED element setting region extend to the spare LED element setting region and are insulated from each other, when the LED element is damaged, the spare LED element is disposed on the spare LED element setting region, such that the pixel driving circuit corresponding to the damaged LED element is used to drive the spare LED element to emit light through the first electrode connecting piece. Therefore, the problem in the related art is solved that the sub-pixel where the LED element is located cannot be displayed due to the damage of the LED element, thus affecting the display effect. In addition, since the first electrode connecting pieces of the adjacent two sub-pixels on two sides of the spare LED element setting region extend to the spare LED element setting region, the pixel driving circuit corresponding to the damaged LED element is used to drive the spare LED element to emit light through the first electrode connecting piece, so that it is not necessary to separately set the pixel driving circuit for the spare LED element, thereby simplifying the process steps.

Optionally, still referring to FIG. 2 and FIG. 3, the first electrode connecting piece 51, the second electrode connecting piece 52 and the spare second electrode connecting piece 53 are disposed on a side of the pixel driving circuit 30 facing away from the base substrate 10.

In this embodiment, considering the following situation that, if the first electrode connecting piece 51, the second electrode connecting piece 52 and the spare second electrode connecting piece 53 are disposed on a same layer as part of films in the pixel driving circuit 30, for example, the first electrode connecting piece 51, the second electrode connecting piece 52 and the spare second electrode connecting piece 53 are disposed on the same layer as the source and the drain in the pixel driving circuit 30, then more lines would be disposed in the film where the source and the drain in the pixel driving circuit 30 are located, so that if the first electrode connecting piece 51, the second electrode connecting piece 52, and the spare second electrode connecting piece 53 are similarly disposed in this layer, in order to prevent a short circuit between the first electrode connecting piece 51, the second electrode connecting piece 52 and the spare second electrode connecting piece 53 and other lines, a region where the pixel driving circuit 30 is located needs to be configured larger, which reduces the resolution of the display panel. In this embodiment, the first electrode connecting piece 51, the second electrode connecting piece 52 and the spare second electrode connecting piece 53 are disposed on the side of the pixel driving circuit 30 facing away from the base substrate 10. Compared with the configuration where the first electrode connecting piece 51, the second electrode connecting piece 52 and the spare second electrode connecting piece 53 are disposed on the same layer as the part of films in the pixel driving circuit 30, this embodiment is conducive to reducing the area occupied by the pixel driving circuit 30 and improving the resolution of the display panel, thereby improving the display effect of the display panel.

Figure 11:
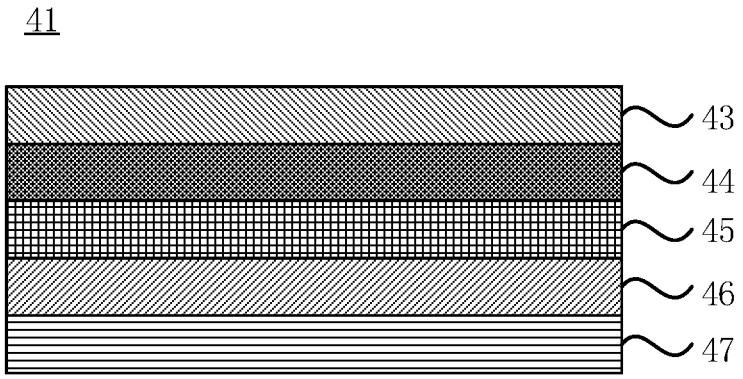
FIG. 11 is a schematic diagram of an LED element according to an embodiment of the present disclosure.
Figure 12:
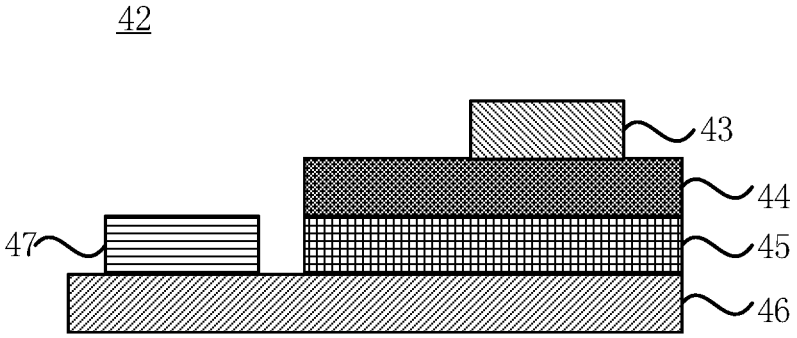
FIG. 12 is a schematic diagram of another LED element according to an embodiment of the present disclosure.

Optionally, FIG. 11 is a schematic diagram of an LED element according to an embodiment of the present disclosure. The LED element 40 includes a single-electrode LED element 41. The single-electrode LED element 41 includes a first electrode 43, a first-type semiconductor layer 44, an active layer 45, a second-type semiconductor layer 46 and a second electrode 47 disposed in sequence and facing away from the base substrate. Alternatively, FIG. 12 is a schematic diagram of another LED element according to an embodiment of the present disclosure. As shown in FIG. 12, the LED element 40 includes a dual-electrode LED element 42. The dual-electrode LED 42 element includes a first-type semiconductor layer 44, an active layer 45 and a second-type semiconductor layer 46 disposed in sequence and facing away from the base substrate; and further includes a first electrode 43 and a second electrode 47. The first electrode 43 is disposed on a side of the first-type semiconductor layer 44 facing away from the active layer 45, and the second electrode 47 is disposed on a side of the second-type semiconductor layer 46 facing towards the active layer 45.

Specifically, the LED element may include the single-electrode LED element 41 or may also include the dual-electrode LED element 42. Those skilled in the art may select the LED element according to the actual situation, which is not specifically limited in this embodiment. At the same time, a specific material of the LED element will not be specifically limited in this embodiment, that is, materials of the first-type semiconductor layer 44, the active layer 45 and the second-type semiconductor layer 46 are not limited in this embodiment, and different materials are selected according to light emitting colors of different LED elements 40. For example, materials of gallium nitride, gallium arsenide or the like may be included.

Figure 13:
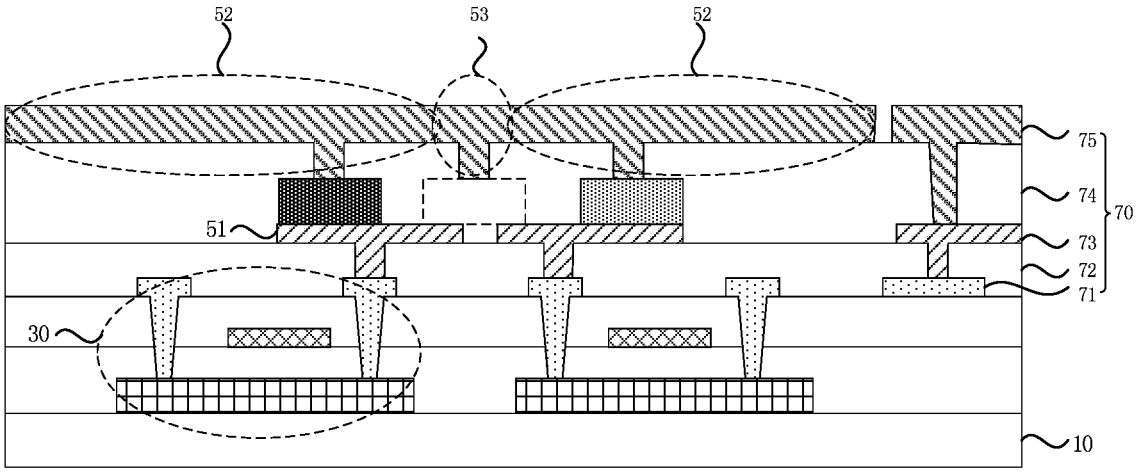
FIG. 13 is a schematic diagram of a film structure of a display panel according to an embodiment of the present disclosure.

On the basis of the above-mentioned solution, optionally, FIG. 13 is a schematic diagram of a film structure of a display panel according to an embodiment of the present disclosure. As shown in FIG. 13, the display panel further includes a bonding pad 70 disposed on one side of the base substrate 10. The bonding pad 70 includes a first conductive structure 71 disposed on the base substrate 10, a first pad layer 72 disposed on a side of the first conductive structure 71 facing away from the base substrate 10, a second conductive structure 73 disposed on a side of the first pad layer 72 facing away from the first conductive structure 71, a second pad layer 74 disposed on a side of the second conductive structure 73 facing away from the first pad layer 72, and a third conductive structure 75 disposed on a side of the second pad layer 74 facing away from the second conductive structure 73. The LED element 40 includes the single-electrode LED element 41. The single-electrode LED element 41 includes the first electrode, the first-type semiconductor layer, the active layer, the second-type semiconductor layer, and the second electrode (not shown in the FIG. 13) disposed in sequence and facing away from the base substrate. The second electrode connecting piece 52, the spare second electrode connecting piece 53 and the third conductive structure 75 are disposed on a same layer. The first electrode connecting piece 51 and the second conductive structure 73 are disposed on a same layer. Sources and drains of transistors of the plurality of pixel driving circuits 30 and the first conductive structure 71 are disposed on a same layer.

One side of the base substrate 10 is further provided with the bonding pad 70. The bonding pad 70 may be used to bind a drive chip such that the drive chip can be electrically connected to a signal line such as a data line and a scanning line through the bonding pad 70. Alternatively, the bonding pad 70 may be used to bind a flexible printed circuit board on which a drive chip is provided, such that the drive chip can be electrically connected to the signal line, such as the data line and the scanning line, through traces on the flexible printed circuit board and the bonding pad 70. In this way, a scanning signal is provided for the pixel driving circuit 30 through the scanning line, and a data signal is provided for the pixel driving circuit 30 through the data line.

Specifically, the bonding pad 70 includes the first conductive structure 71, the first pad layer 72, the second conductive structure 73, the second pad layer 74 and the third conductive structure 75, where the second electrode connecting piece 52, the spare second electrode connecting piece 53 and the third conductive structure 75 are disposed on the same layer, the first electrode connecting piece 51 and the second conductive structure 73 are disposed on the same layer, the sources and drains of the transistors of the plurality of pixel driving circuits 30 and the first conductive structure 71 are disposed on the same layer, and the first pad layer 72 and the second pad layer 74 are respectively disposed on same layers as insulating layers of the pixel driving circuit 30. Advantages of this configuration are described below. The structure is simple, no additional technological process needs to be added, a technological process is reduced, a manufacturing cost of the display panel is reduced, and a manufacturing efficiency of a touch display panel is improved.

It could be understood by those skilled in the art that in order to facilitate explanation of a relative positional relationship between the bonding pad 70 and the sub-pixel 20, FIG. 13 merely simply shows the relative positional relationship between the bonding pad 70 and the sub-pixels 20. In order to clearly explain the relative positional relationship between the bonding pad 70 and the sub-pixels 20 hereinafter, only the bonding pad 70 and the sub-pixels 20 are shown in the figure, but other signal lines, structures and the like are actually also included between the sub-pixels 20 and the bonding pad 70. For example, fan-out traces, lighting test circuits and the like may further be included, which are not shown here. The following embodiments are identical and the above descriptions will not be repeated.

Optionally, the bonding pad 70 may further include a fourth conductive structure (not shown in the figure), where the fourth conductive structure is disposed on the same layer as a gate in the pixel driving circuit 30 such that the loss of the bonding pad 70 can be reduced without increasing the process steps.

Figure 14:
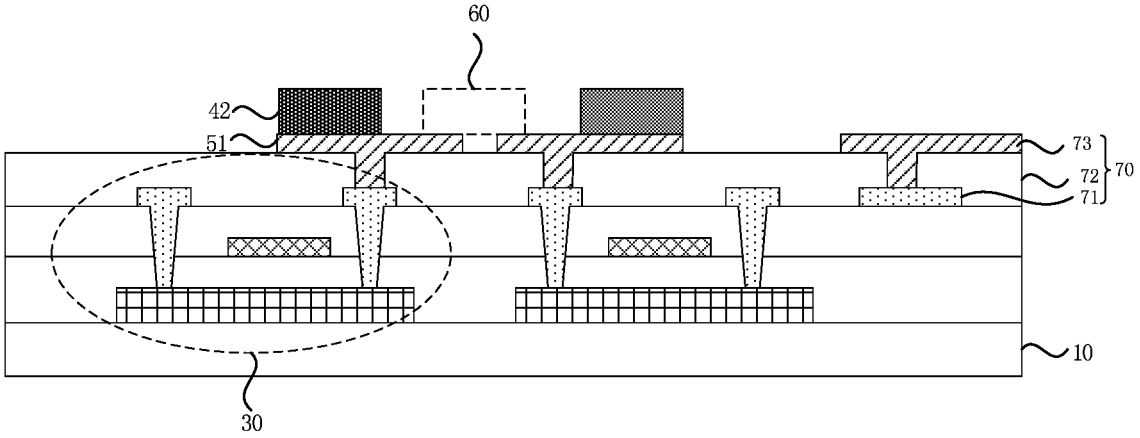
FIG. 14 is a schematic diagram of a film structure of another display panel according to an embodiment of the present disclosure.

Optionally, FIG. 14 is a schematic diagram of a film structure of another display panel according to an embodiment of the present disclosure. As shown in FIG. 14, the display panel further includes a bonding pad 70 disposed on one side of the base substrate 10. The bonding pad 70 includes a first conductive structure disposed on the base substrate, a first pad layer 72 disposed on a side of the first conductive structure 71 facing away from the base substrate 10, and a second conductive structure 73 disposed on a side of the first pad layer 72 facing away from the base substrate 10. The LED element 40 includes the dual-electrode LED element 42. The dual-electrode LED element 42 includes the first-type semiconductor layer, the active layer and the second-type semiconductor layer disposed in sequence and facing away from the base substrate; and further includes the first electrode and the second electrode. The first electrode is disposed on the side of the first-type semiconductor layer facing away from the active layer, and the second electrode is disposed on the side of the second-type semiconductor layer facing towards the active layer. The first electrode connecting piece 51, the second electrode connecting piece 52 (not shown in FIG. 14), the spare second electrode connecting piece 53 and the second conductive structure 73 are disposed on a same layer. The sources and drains of the transistors of the plurality of pixel driving circuits 30 and the first conductive structure 71 are disposed on a same layer.

Specifically, the bonding pad 70 includes the first conductive structure 71, the first pad layer 72 and the second conductive structure 73, where the first electrode connecting piece 51, the second electrode connecting piece 52 (not shown in FIG. 14), the spare second electrode connecting piece 53 (not shown in FIG. 14) and the second conductive structure 73 are disposed on the same layer; and the sources and drains of the transistors of the plurality of pixel driving circuits 30 and the first conductive structure 71 are disposed on the same layer, and the first pad layer 72 and an insulating layer of the pixel driving circuits 30 are disposed on a same layer. Advantages of this configuration are described below. The structure is simple, no additional technological process needs to be added, a technological process is reduced, a manufacturing cost of the display panel is reduced, and a manufacturing efficiency of a touch display panel is improved.

Optionally, the bonding pad 70 may further include a third conductive structure (not shown in FIG. 14), where the third conductive structure is disposed on the same layer as the gate in the pixel driving circuit 30 such that the loss of the bonding pad 70 can be reduced without increasing the process steps.

Optionally, still referring to FIG. 5, FIG. 6 and FIG. 7, the display panel further includes a plurality of first electrode lines 81 and a plurality of second electrode lines 82; at least part of adjacent columns of sub-pixels 20 are provided with the plurality of spare LED element setting regions 60, and at least one side of each column of sub-pixels 20 is provided with the plurality of spare LED element setting regions 60; the second electrode connecting pieces 52 and the spare second electrode connecting piece 53 in a same row are connected to a same second electrode line 82; pixel driving circuits 30 of sub-pixels 20 of a same column are connected to a same first electrode line 81; and the plurality of first electrode lines 81 is parallel to the column direction and the plurality of second electrode lines 82 is parallel to the row direction.

Specifically, the first electrode line 81 provides a data signal to the sub-pixel 20, and the second electrode line 82 provides a cathode signal to the sub-pixel 20. It could be understood that the display panel further includes other signal lines, such as anode signal lines, scanning lines and other signal lines known to those skilled in the art. Specifically, the first electrode lines 81 are parallel to the column direction, the data signals are provided to the sub-pixels 20 of the same column through one first electrode line 81, and the data signals are provided to sub-pixels 20 of each column through the plurality of first electrode lines 81 respectively. Since at least part of the adjacent columns of sub-pixels 20 are provided with the plurality of spare LED element setting regions 60, and at least one side of each column of sub-pixels 20 is provided with the plurality of spare LED element setting regions 60, the second electrode lines 82 need to be parallel to the row direction to provide cathode signals to the sub-pixels 20 in the same row and to the spare LED element disposed in the spare LED element setting region 60 when an LED element 40 is damaged therein, and the plurality of second electrode lines 82 provide cathode signals to each row of sub-pixels 20 respectively.

When the plurality of first electrode lines 81 is parallel to the column direction and the plurality of second electrode lines 82 is parallel to the row direction, optionally, still referring to FIG. 5, FIG. 6 and FIG. 7, the first electrode lines 81 and the second electrode lines 82 are disposed on different layers.

Specifically, considering the following situation that, an extending direction of the first electrode line 81 intersects an extending direction of the second electrode line 82, if the first electrode line 81 and the second electrode line 82 are disposed on a same layer, the first electrode line 81 and the second electrode line 82 will be short circuited. In this way, a data signal transmitted by the first electrode line 81 and a cathode signal transmitted by the second electrode line 82 interfere with each other, thereby affecting the display. In this embodiment, the first electrode line 81 and the second electrode line 82 are separately disposed on different films. The advantage of this configuration is that a transmission of the signal can be achieved while preventing the short circuit between the first electrode line 81 and the second electrode line 82.

Optionally, still referring to FIG. 6, the first electrode line 81 may be disposed on the same layer as the sources and drains of the transistors of the pixel driving circuits 30. Advantages of this configuration are described below. The structure is simple, no additional technological process needs to be added, the technological process is reduced, the manufacturing cost of the display panel is reduced, and the manufacturing efficiency of the touch display panel is improved.

Figure 15:
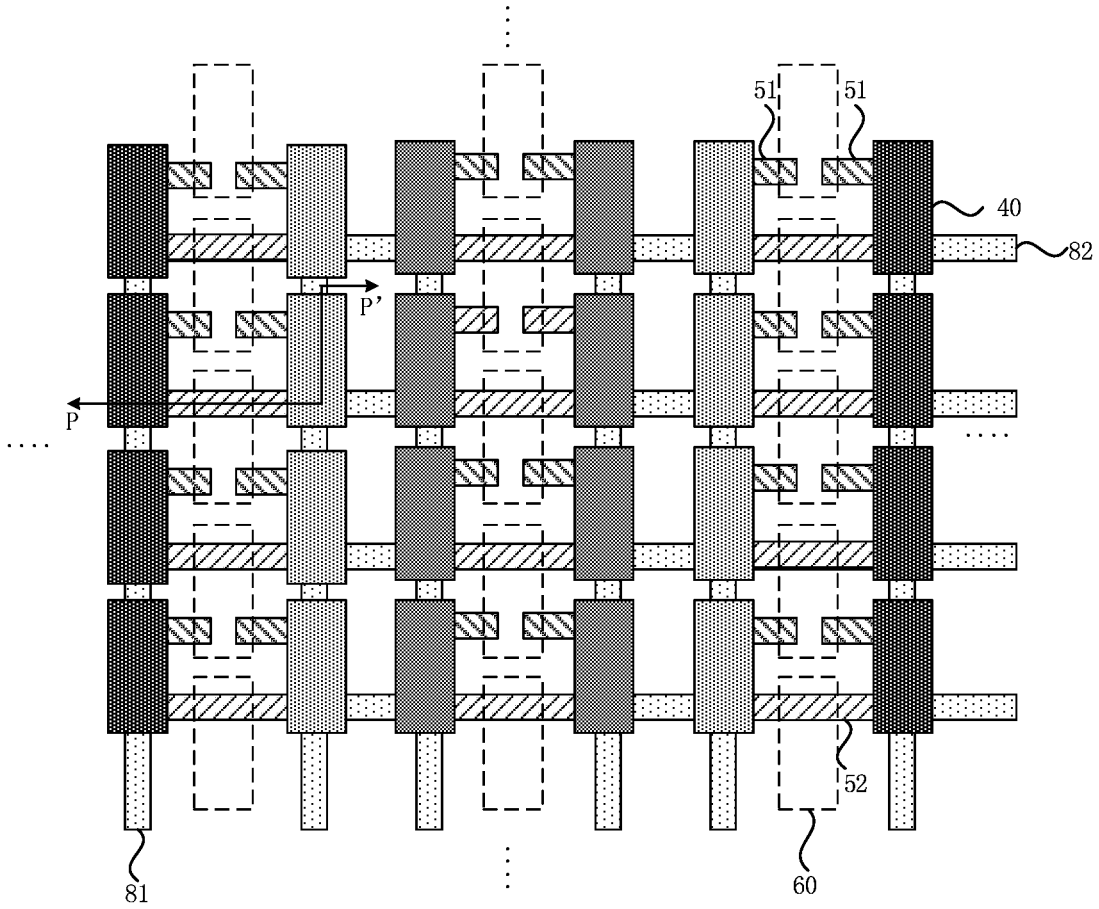
FIG. 15 is a schematic diagram of another display panel according to an embodiment of the present disclosure.
Figure 16:
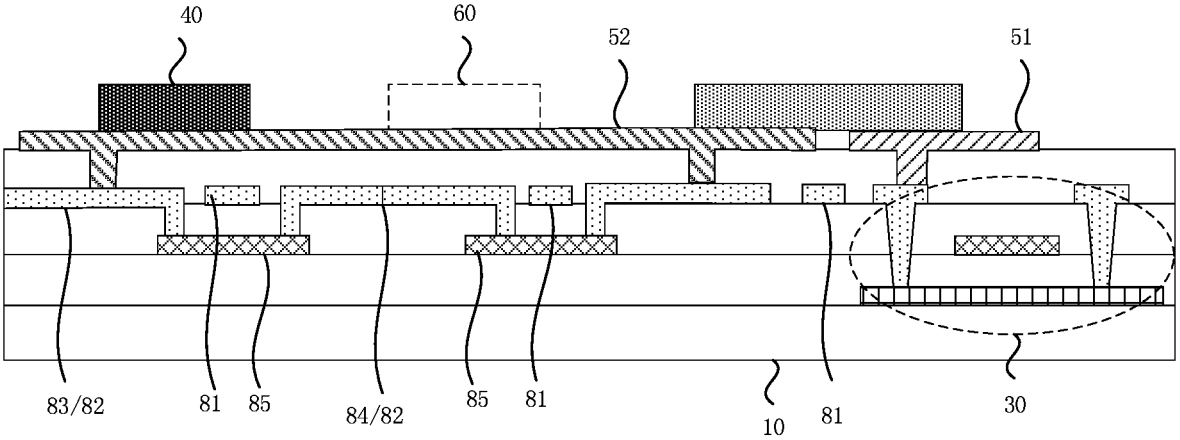
FIG. 16 is a cross-sectional view taken along line P-P' shown in FIG. 15.

When the plurality of first electrode lines 81 is parallel to the column direction and the plurality of second electrode lines 82 is parallel to the row direction, optionally, FIG. 15 is a schematic diagram of another display panel according to an embodiment of the present disclosure and FIG. 16 is a cross-sectional view along a direction P-P' illustrated in FIG. 15. As shown in FIG. 15 and FIG. 16, the first electrode line 81 and the second electrode line 82 are disposed on a same layer; the first electrode line 81 or the second electrode line 82 is provided with a first portion 83 and a second portion 84, the first portion 83 is electrically connected to the second portion 84 through a jumper wire structure 85; the jumper wire structure 85 is located at a crossing portion of the first electrode line 81 and the second electrode line 82; and the jumper wire structure 85 and the first electrode line 81 and the second electrode line 82 are disposed on different layers.

Specifically, considering the following situation that the extending direction of the first electrode line 81 intersects with the extending direction of the second electrode line 82, if the first electrode line 81 and the second electrode line 82 are disposed on the same layer, the first electrode line 81 and the second electrode line 82 will be short circuited. In this way, the data signal transmitted by the first electrode line 81 and the cathode signal transmitted by the second electrode line 82 interfere with each other, thereby affecting the display. In this embodiment, jumper wires are disposed at the crossing portion of the first electrode line 81 and the second electrode line 82 to prevent the short circuit. There are many ways to configure the jumper wire, and those skilled in the art can configure the jumper wire according to the actual situation, which will not be limited herein. Exemplarily, as shown in FIG. 15 and FIG. 16, the jumper wire structure 85 is disposed in a metal layer where the gate of the pixel driving circuit 30 is located. In other embodiments, for example, a metal layer may further be provided separately, and the metal layer includes the jumper wire structure 85 (not shown in the figure).

It is to be noted that FIG. 15 and FIG. 16 only exemplarily illustrate that the second electrode line 82 is provided with the first portion 83 and the second portion 84, and the first portion 83 of the second electrode line 82 and the second portion 84 of the second electrode line 82 are electrically connected through the jumper wire structure 85.

When the first electrode line 81 and the second electrode line 82 are disposed on the same layer, optionally, still referring to FIG. 15 and FIG. 16, the first electrode line 81 and the second electrode line 82 may further be disposed on a same layer as the sources and drains of the transistors of the pixel driving circuit 30. The first electrode line 81 and the second electrode line 82 and the film in the pixel driving circuit 30 are made of a same material in a same process. Advantages of this configuration are described below. The structure is simple, no additional technological process needs to be added, the technological process is reduced, and the manufacturing cost of the display panel is reduced.

Optionally, still referring to FIG. 1 and FIG. 2, the display panel further includes the plurality of first electrode lines 81 and the plurality of second electrode lines 82; at least part of adjacent rows of sub-pixels 20 are provided with the plurality of spare LED element setting regions 60, and at least one side of each row of sub-pixels 20 is provided with the plurality of spare LED element setting regions 60; the second electrode connecting pieces 52 and the spare second electrode connecting piece 53 in a same column are connected to a same second electrode line 82; pixel driving circuits 30 of sub-pixels 20 of a same column are connected to a same first electrode line 81; and both the first electrode lines 81 and the second electrode lines 82 are parallel to the column direction.

Specifically, the first electrode line 81 provides the data signal to the sub-pixel 20, and the second electrode line 82 provides the cathode signal to the sub-pixel 20. It could be understood that the display panel further includes other signal lines, such as anode signal lines, scanning lines and other signal lines known to those skilled in the art. Specifically, the first electrode lines 81 are parallel to the column direction, the data signal is provided to the sub-pixels 20 of the same column through one first electrode line 81, and data signals are provided to sub-pixels 20 of each column through the plurality of first electrode lines 81 respectively; and the second electrode lines 82 are also parallel to the column direction, and the cathode signal is provided to the sub-pixels 20 of the same column through one second electrode line 82, and cathode signals are provided to sub-pixels 20 of each row through the plurality of second electrode lines 82 respectively.

Figure 17:
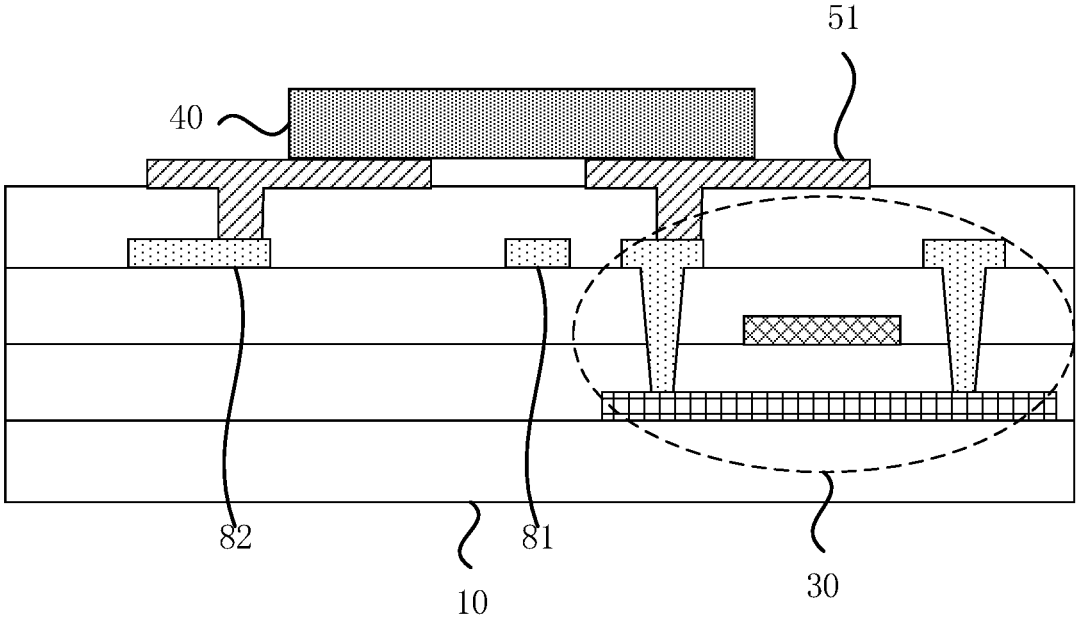
FIG. 17 is a schematic diagram of a film structure of another display panel according to an embodiment of the present disclosure.

When both the first electrode lines 81 and the second electrode lines 82 are parallel to the column direction, optionally, FIG. 17 is a schematic diagram of a film structure of another display panel according to an embodiment of the present disclosure, and the first electrode lines 81 and the second electrode lines 82 are disposed on the same layer.

Specifically, since both the first electrode lines 81 and the second electrode lines 82 are parallel to the column direction and do not intersect with each other, the first electrode lines 81 and the second electrode lines 82 may be disposed on the same layer, that is, the first electrode lines 81 and the second electrode lines 82 are made of a same material in a same process. In this way, the structure is simple, no additional technological process needs to be added, the technological process is reduced, and the manufacturing cost of the display panel is reduced.

Optionally, the first electrode lines 81 and the second electrode lines 82 are disposed in different layers. Advantages of this configuration are described below. The data signal transmitted by the first electrode line 81 and the cathode signal transmitted by the second electrode line 82 do not interfere with each other, and the second electrode lines 82 do not need to be patterned, simplifying the process steps.

Optionally, still referring to FIG. 17, the first electrode line 81 and the second electrode line 82 are disposed on the same layer as the sources and drains of the transistors of the pixel driving circuits 30.

Specifically, the first electrode line 81 and the second electrode line 82 and the film in the pixel driving circuit 30 are made of the same material in the same process. The structure is simple, no additional technological process needs to be added, the technological process is reduced, and the manufacturing cost of the display panel is reduced.

Figure 18:
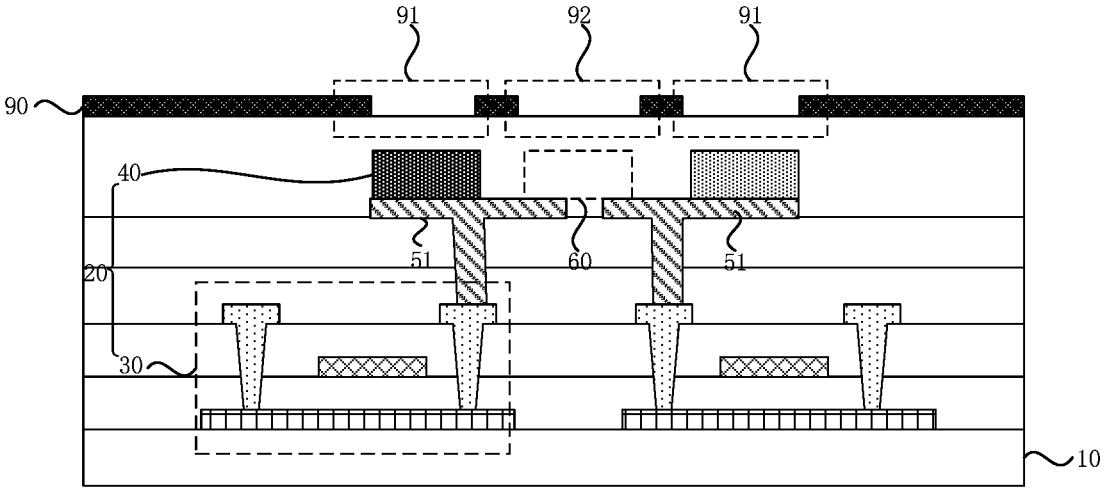
FIG. 18 is a schematic diagram of a film structure of another display panel according to an embodiment of the present disclosure.

Optionally, FIG. 18 is a schematic diagram of a film structure of another display panel according to an embodiment of the present disclosure. As shown in FIG. 18, the display panel provided by the embodiment of the present disclosure further includes a black matrix 90. The black matrix 90 is disposed on a side of the plurality of sub-pixels 20 facing away from the base substrate 10. The black matrix 90 is provided with a plurality of first openings 91 and a plurality of second openings 92. A vertical projection of the LED element 40 on the base substrate 10 is located within a vertical projection of the first opening 91 on the base substrate 10. The spare LED element setting region 60 is located within a vertical projection of the second opening 92 on the base substrate 10.

Specifically, the black matrix 90 is provided such that, in one aspect, the LED element 40 is exposed through the first opening 91 of the black matrix 90 without affecting the display of the sub-pixel 20. When the LED element 40 is damaged, the spare LED element may be disposed in the spare LED element setting region 60, and since the spare LED element setting region 60 is exposed through the second opening 92 of the black matrix 90, even if the LED element 40 is damaged, the spare LED element will not be shielded, and thus the display of the sub-pixel 20 will not be affected. In another aspect, the black matrix 90 prevents reflection of external light after irradiating off the metal structures in the sub-pixel 20, for example, the sources and drains of the transistors of the pixel driving circuit 30, thereby solving the problem that the metal structure is visible.

Based on the same inventive concept, the embodiment of the present disclosure further provides a display device. The display device includes the display panel of any one of the embodiments of the present disclosure. Therefore, the display device provided by the embodiment of the present disclosure has the corresponding beneficial effects of the display panel provided by the embodiment of the present disclosure, and the beneficial effects will not be repeated here. Exemplarily, the display device may be an electrical device of a mobile phone, a computer, a smart intelligent wearable device (for example, a smart watch), a vehicle-mounted display device and the like, which is not limited in the embodiment of the present disclosure.

Figure 19:
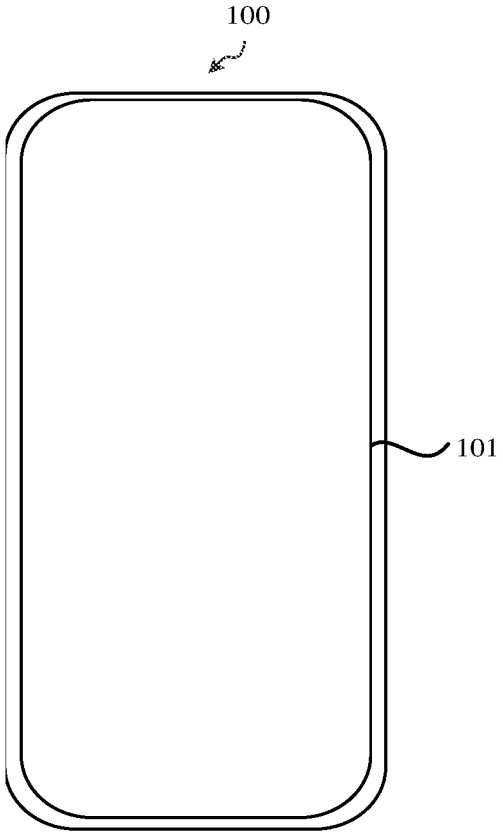
FIG. 19 is a schematic diagram of a display device according to an embodiment of the present disclosure.

Exemplarily, FIG. 19 is a schematic diagram of a display device according to an embodiment of the present disclosure. As shown in FIG. 19, the display device 100 includes the display panel 101 in the above-mentioned embodiments.

The foregoing merely depict some illustrative embodiments in accordance with the present disclosure as well as the technical principles employed herein. Those skilled in the art will be able to understand that the present disclosure will not be limited to the specific embodiments described herein. Those skilled in the art may make various apparent modifications, adaptations and substitutions without departing from the scope of the present disclosure. Therefore, while the present disclosure has been described in detail through the foregoing embodiments, the present disclosure will not be limited to these embodiments and may further include additional equivalent embodiments without departing from the concept of the present disclosure. The scope of the present disclosure is thus determined in and by the appended claims.

What is claimed is:

1. A display panel, comprising:

a base substrate;

a plurality of sub-pixels arranged in an array on a side of the base substrate, the plurality of sub-pixels each comprising a pixel driving circuit and a light emitting diode (LED) element; and a plurality of first electrode connecting pieces and a plurality of second electrode connecting pieces, wherein the plurality of pixel driving circuits are electrically connected to first electrodes of LED elements of the plurality of sub-pixels in one-to-one correspondence through the plurality of first electrode connecting pieces, and the plurality of second electrode connecting pieces are electrically connected to second electrodes of the LED elements of the plurality of sub-pixels in one-to-one correspondence;

wherein at least part of adjacent rows of sub-pixels are provided with a plurality of spare LED element setting regions between the adjacent rows, and the plurality of spare LED element setting regions are provided on at least one side of each row of the plurality of sub-pixels, and/or at least part of adjacent columns of sub-pixels are provided with the plurality of spare LED element setting regions between the adjacent columns, and the plurality of spare LED element setting regions are provided on at least one side of each column of the plurality of sub-pixels;

wherein two adjacent sub-pixels on two sides of each of the plurality of spare LED element setting regions are respectively a first sub-pixel and a second sub-pixel, wherein the first electrode connecting piece electrically connected to the first sub-pixel and the first electrode connecting piece electrically connected to the second sub-pixel both extend to the spare LED element setting region between the first sub-pixel and the second sub-pixel and are insulated from each other, and the spare LED element setting region is further provided with a spare second electrode connecting piece, wherein the spare second electrode connecting piece and the plurality of second electrode connecting piece are connected in an integral structure.

2. The display panel of claim 1, wherein the plurality of sub-pixels arranged in the array comprises a plurality of sub-pixel rows, the plurality of sub-pixel rows comprising a plurality of sub-pixel row units, and the plurality of sub-pixel row units each comprising a first sub-pixel row and a second sub-pixel row; and the plurality of spare LED element setting regions are arranged between the first sub-pixel row and the second sub-pixel row.

3. The display panel of claim 1, wherein the plurality of sub-pixels arranged in the array comprises a plurality of sub-pixel columns, the plurality of sub-pixel columns comprising a plurality of sub-pixel column units, and the plurality of sub-pixel column units each comprising a first sub-pixel column and a second sub-pixel column; and the plurality of spare LED element setting regions are arranged between the first sub-pixel column and the second sub-pixel column.

4. The display panel of claim 1, wherein the spare LED element setting regions are arranged between the adjacent sub-pixels along a row direction and/or a column direction.

5. The display panel of claim 1, wherein the plurality of first electrode connecting pieces, the plurality of second electrode connecting pieces, and the spare second electrode connecting pieces are disposed on a side of the plurality of pixel driving circuits facing away from the base substrate.

6. The display panel of claim 1, wherein the LED element comprises a single-electrode LED element, which comprises a first electrode, a first-type semiconductor layer, an active layer, a second-type semiconductor layer, and a second electrode sequentially disposed and facing away from the base substrate;

or the LED element comprises a dual-electrode LED element, which comprises a first-type semiconductor layer, an active layer, and a second-type semiconductor layer sequentially disposed and facing away from the base substrate; the LED element further comprises a first electrode disposed on a side of the first-type semiconductor layer facing away from the active layer, and a second electrode disposed on a side of the second-type semiconductor layer facing towards the active layer.

7. The display panel of claim 6, further comprising a bonding pad disposed on one side of the base substrate, the bonding pad comprising a first conductive structure disposed on the base substrate, a first pad layer disposed on a side of the first conductive structure facing away from the base substrate, a second conductive structure disposed on a side of the first pad layer facing away from the first conductive structure, a second pad layer disposed on a side of the second conductive structure facing away from the first pad layer, and a third conductive structure disposed on a side of the second pad layer facing away from the second conductive structure;

wherein the LED element comprises the single-electrode LED element, which comprises the first electrode, the first-type semiconductor layer, the active layer, the second-type semiconductor layer, and the second electrode sequentially disposed and facing away from the base substrate;

wherein the second electrode connecting piece and the spare second electrode connecting piece are disposed on a same layer as the third conductive structure;

the first electrode connecting piece is disposed on a same layer as the second conductive structure; and sources and drains of transistors of the plurality of pixel driving circuits are disposed on a same layer as the first conductive structure.

8. The display panel of claim 6, further comprising a bonding pad disposed on one side of the base substrate, the bonding pad comprising a first conductive structure disposed on the base substrate, a first pad layer disposed on a side of the first conductive structure facing away from the base substrate, and a second conductive structure disposed on a side of the first pad layer facing away from the base substrate;

wherein the LED element comprises the dual-electrode LED element, which comprises the first-type semiconductor layer, the active layer, and the second-type semiconductor layer sequentially disposed and facing away from the base substrate; the LED element further comprises the first electrode disposed on a side of the first-type semiconductor layer facing away from the active layer, and the second electrode disposed on a side of the second-type semiconductor layer facing towards the active layer;

wherein the first electrode connecting piece, the second electrode connecting piece, and the spare second electrode connecting piece are disposed on a same layer as the second conductive structure; and sources and drains of transistors of the plurality of pixel driving circuits are disposed on a same layer as the first conductive structure.

9. The display panel of claim 1, further comprising a plurality of first electrode lines and a plurality of second electrode lines;

wherein the at least part of adjacent columns of the sub-pixels are provided with the plurality of spare LED element setting regions between the adjacent columns, the plurality of spare LED element setting regions are provided on at least one side of each column of the plurality of sub-pixels; the second electrode connecting pieces and the spare second electrode connecting pieces in a same row are connected to a same second electrode line; and pixel driving circuits of the sub-pixels of a same column are connected to a same first electrode line; and the plurality of first electrode lines are parallel to a column direction and the plurality of second electrode lines are parallel to a row direction.

10. The display panel of claim 9, wherein the plurality of first electrode lines and the plurality of second electrode lines are disposed on a same layer;

each of the plurality of first electrode lines or each of the plurality of second electrode lines comprises a first portion and a second portion, the first portion is electrically connected to the second portion through a jumper wire structure, the jumper wire structure being disposed at a crossing portion of the first electrode line and the second electrode line; and the juniper wire structure is disposed on a different layer than the first electrode line and the second electrode line.

11. The display panel of claim 1, further comprising a plurality of first electrode lines and a plurality of second electrode lines;

wherein the at least part of adjacent rows of the sub-pixels are provided with the plurality of spare LED element setting regions between the adjacent rows, and the plurality of spare LED element setting regions are provided on at least one side of each row of the plurality of sub-pixels; the second electrode connecting pieces and the spare second electrode connecting pieces in a same column are connected to a same second electrode line; and pixel driving circuits of the sub-pixels of a same column are connected to a same first electrode line; and wherein both the plurality of first electrode lines and the plurality of second electrode lines are parallel to a column direction.

12. The display panel of claim 11, wherein the plurality of first electrode lines and the plurality of second electrode lines are disposed on a same layer.

13. The display panel of claim 9, wherein the plurality of first electrode lines are disposed on a different layer than the plurality of second electrode lines.

14. The display panel of claim 11, wherein the plurality of first electrode lines are disposed on a different layer than the plurality of second electrode lines.

15. The display panel of claim 10, wherein the plurality of first electrode lines and the plurality of second electrode lines are disposed on a same layer as sources and drains of transistors of the plurality of pixel driving circuits.

16. The display panel of claim 12, wherein the plurality of first electrode lines and the plurality of second electrode lines are disposed on a same layer as sources and drains of transistors of the plurality of pixel driving circuits.

17. The display panel of claim 1, further comprising a black matrix disposed on a side of the plurality of sub-pixels facing away from the base substrate;

wherein the black matrix is provided with a plurality of first openings and a plurality of second openings; and a vertical projection of the LED element on the base substrate is located within a vertical projection of a first opening oi the base substrate; and the spare LED element setting region is located within a vertical projection of a second opening on the base substrate.

18. A display device, comprising the display panel of claim 1.

19. The display device of claim 18, wherein the plurality of sub-pixels arranged in the array comprises a plurality of sub-pixel rows, the plurality of sub-pixel rows comprising a plurality of sub-pixel row units, and the plurality of sub-pixel row units each comprising a first sub-pixel row and a second sub-pixel row; and the plurality of spare LED element setting regions are arranged between the first sub-pixel row and the second sub-pixel raw.

20. The display device of claim 18, wherein the plurality of sub-pixels arranged in the array comprises a plurality of sub-pixel columns, the plurality of sub-pixel columns comprising a plurality of sub-pixel column units, and the plurality of sub-pixel column units each comprising a first sub-pixel column and a second sub-pixel column; and the plurality of spare LED element setting regions are arranged between the first sub-pixel column and the second sub-pixel column.

* * * * *